US007762271B2

(12) United States Patent
Funk

(10) Patent No.: US 7,762,271 B2
(45) Date of Patent: Jul. 27, 2010

(54) MATERIAL DELIVERY SUPPORT DEVICE FOR BOOM AND METHOD OF USE

(75) Inventor: Carsten Funk, Pfullingen (DE)

(73) Assignee: Putzmeister, Inc., Sturtevant, WI (US)

( * ) Notice: Subject to any disclaimer, the term of this patent is extended or adjusted under 35 U.S.C. 154(b) by 759 days.

(21) Appl. No.: 11/683,132

(22) Filed: Mar. 7, 2007

(65) Prior Publication Data

US 2008/0219822 A1 Sep. 11, 2008

(51) Int. Cl.
*E03B 1/00* (2006.01)

(52) U.S. Cl. ..... 137/1; 137/615

(58) Field of Classification Search ..... 137/351, 137/615, 1; 414/495, 680; 248/49, 56, 328
See application file for complete search history.

(56) References Cited

U.S. PATENT DOCUMENTS 3,096,797 A * 7/1963 Bily ..... 137/615
3,221,772 A * 12/1965 Arntzen ..... 137/615
3,451,628 A * 6/1969 Kelley ..... 137/615
3,459,222 A * 8/1969 McElroy ..... 137/615
3,599,722 A * 8/1971 Davidson et al. ..... 169/25
3,675,680 A * 7/1972 Frohlich et al. ..... 137/615
3,707,990 A 1/1973 Schaible et at
3,884,528 A * 5/1975 Shaddock ..... 137/615
3,942,554 A * 3/1976 Werner et al. ..... 137/615
3,964,512 A * 6/1976 Dumas ..... 137/615
4,130,134 A * 12/1978 Castle ..... 137/615
4,280,771 A 7/1981 Schwing et al.
4,299,262 A * 11/1981 Andrepont ..... 137/615
4,519,768 A * 5/1985 Murai et al. ..... 137/615
4,625,760 A 12/1986 Mertens
5,256,005 A * 10/1993 Beck, III ..... 405/240
5,535,780 A * 7/1996 Schlecht et al. ..... 137/615
6,220,292 B1 4/2001 Woodling et al.
6,230,741 B1 5/2001 Woodling et al.
6,378,686 B1 * 4/2002 Mayer et al. ..... 198/314
6,588,448 B1 7/2003 Raymond
6,679,284 B1 1/2004 Raymond
6,698,451 B2 * 3/2004 Anderson et al. ..... 137/615
6,719,009 B1 * 4/2004 Bissen et al. ..... 137/615
6,779,688 B1 * 8/2004 Mayer ..... 137/615
6,823,888 B1 11/2004 Raymond
6,871,667 B2 3/2005 Schwing et al.

FOREIGN PATENT DOCUMENTS

DE 102007016354 A1 * 10/2008

* cited by examiner

*Primary Examiner*—John Rivell
*Assistant Examiner*—Craig Price
(74) *Attorney, Agent, or Firm*—Andrus, Sceales, Starke & Sawall, LLP

(57) ABSTRACT

A material delivery support device is provided for supporting a tubular delivery system from an outermost end of an extendable boom arm. The material delivery support device includes a rigid support arrangement having an upper rigid portion attached to the outermost end of the boom arm, and a lower rigid portion secured to the tubular material delivery system below the upper rigid portion. A flexible support assembly extends between the upper and lower rigid portions and surrounds the tubular material delivery system. The tubular material delivery system is substantially supported from the upper rigid portion of the rigid support arrangement.

17 Claims, 4 Drawing Sheets

MATERIAL DELIVERY SUPPORT DEVICE FOR BOOM AND METHOD OF USE

FIELD OF THE INVENTION

The present invention relates generally to a support device and method that permits an overweighted, fillable tubular delivery system to be attached to extendable boom structure consistent with the load capacity thereof. More specifically, the present invention pertains to the use of a boom-attached support device and method for supporting a tubular delivery system on a concrete pumping unit.

BACKGROUND OF THE INVENTION

Presently, mobile concrete pumping vehicles and stationary concrete pumping units are available that include a multi-section, rotatable boom arm that is folded into a compact condition during transport and storage. Once the pumping unit is positioned at the work site, the folded boom arm is extended to supply concrete to a remote location. Typically, the boom arm includes a steel boom pipe made up of multiple sections that are supported by the boom arm such that a concrete can be supplied to a remote location on the work site. The boom arm has a cross-sectional area that decreases in size as it extends further away from its center of rotation. The boom arm is designed with a maximum weight-carrying capacity that includes concrete in the boom pipe plus a factor of safety that takes into account dynamics, wind loading, etc. The weight-carrying capacity also takes into consideration the maximum weight that can be suspended from an outermost or tip section of the boom arm in the form of an end hose or "elephant trunk" filled with concrete. The load imposed by the filled end hose is typically between 200 and 400 pounds. Such boom arms are designed for general pumping applications and normally perform well in such capacity.

However, in some applications, it is deemed necessary by the user to hang tubular delivery systems that are heavier and longer than the normally used boom tip section weight. Because the tip section has the weakest cross-section and is holding weight a high moment distance from the center of rotation, the tip section is often removed and the tubular delivery system is then hung from the preceding boom arm section. In general, this has been done by the user without the manufacturer's approval in an improvised manner. If the boom arm design, pipeline support and pipeline coupling designs are not well understood by the modifying user, this can create serious loading problems that can damage the boom arm.

For example, a standard boom arm design may use an end hose that is 5 inches in diameter and 10 feet long. Removing the boom tip section and replacing the standard 10 feet end hose with a 3 foot long, 5 inch to 4 inch steel reducer pipe and 80 feet of 4 inch diameter pipe could seriously compromise the integrity of the boom arm during operation. A particular problem may occur if the boom operator causes contact of the 80 foot pipe with a local structure or by hitting the sidewall of a hole into which the filled pipe is inserted. This creates a side load on the boom arm that could slew the boom sideways in a precarious manner.

Therefore, there is a need to provide a support device that replaces the tip section of a standard boom arm and allows the boom arm to support an overweighted or oversized tubular delivery system other than the standard delivery hose. Further, there is a need to provide a support device for a tubular delivery system on the end of a boom arm in a manner which will preserve the integrity of the boom arm during any operational movement thereof.

SUMMARY OF THE INVENTION

This invention relates to a material delivery support device for supporting a tubular delivery system from an outermost end of an extendable boom arm. The material delivery support device includes a rigid support arrangement having an upper rigid portion attached to the outermost end of the boom arm, and a lower rigid portion secured to the tubular material delivery system below the upper rigid portion. A flexible support assembly extends between the upper and lower rigid portions and surrounds the tubular material delivery system. The tubular material delivery system is substantially supported from the upper rigid portion of the rigid support arrangement.

The upper rigid portion includes a rigid support member having an upper end attached to and extending downwardly from the outermost end of the boom arm, and a lower end secured to an upper support plate. The upper support plate is provided with a series of spaced apart support rings. The lower rigid portion includes a lower support plate spaced from and aligned with the upper support plate. A plurality of spaced apart connectors join the tubular delivery system to the lower support plate. The flexible support assembly includes a series of cables having upper ends secured to the support rings on the upper support plate, and lower threaded ends attached by nuts to the lower support plate.

The tubular delivery system includes a pipe elbow having one end connected to a boom pipe in communication with a source of material, and another end joined to an upper end of a transition hose. The transition hose passes through the upper support plate and terminates in a lower end attached to a reducer pipe that extends through the lower support plate. The boom pipe is supported by a first tubular support extending laterally from the outermost end of the boom arm. The pipe elbow is supported by a second tubular support extending forwardly from the first tubular support, and a third tubular support extending laterally from the support member. The reducer pipe includes an upper pipe coupled to a lower pipe. The upper pipe has a diameter that is larger than a diameter of the lower pipe. The upper pipe has a length which is shorter than a length of the lower pipe.

The invention also relates to a concrete pumping and delivery unit that has an extendable boom arm constructed with a plurality of foldable sections that extend along a center axis and is provided with a boom pipe carrying a supply of concrete stored on the unit. A tubular concrete delivery system is coupled to the boom pipe. A concrete delivery support device is attached to an outermost end of the boom arm for supporting the tubular concrete delivery system therefrom. The support device includes a rigid support member depending from the outermost end of the boom arm and having a first support plate attached thereto. A set of cables extends downwardly from the first support plate. A second support plate is spaced beneath the first support plate and is joined to the set of cables and the tubular concrete delivery system.

The tubular concrete delivery system passes through the first and second support plates and is generally aligned along the center axis of the boom arm. A portion of the tubular concrete delivery system is surrounded by the set of cables. The tubular concrete delivery system includes a pipe elbow connected to the boom pipe, a transition hose joined to the pipe elbow and a reducer pipe coupled to the transition hose. The reducer pipe has a length substantially longer than a length of the transition hose. The pipe elbow is further supported by tubular supports extending from the boom arm and the rigid support member.

The invention further contemplates a method of supporting an oversized tubular delivery system from an outermost section of an extendable boom arm constructed with a plurality of foldable sections and provided with a boom pipe carrying a supply of material and a standard delivery hose depending from the boom pipe. The method includes the steps of a) removing the outermost section of the boom arm and the standard delivery hose; and b) providing a rigid support member having an upper end connected to a new outermost end of the boom arm and a lower end provided with a first support plate, a set of cables extending downwardly from the first support plate and a second support plate spaced from the first support plate and secured to the set of cables such that the tubular delivery system is coupled to the lower pipe, passes through the first and second support plates and is joined to the second support plate. The method further includes the step of further supporting an upper portion of the tubular delivery system from the boom arm and the support member.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
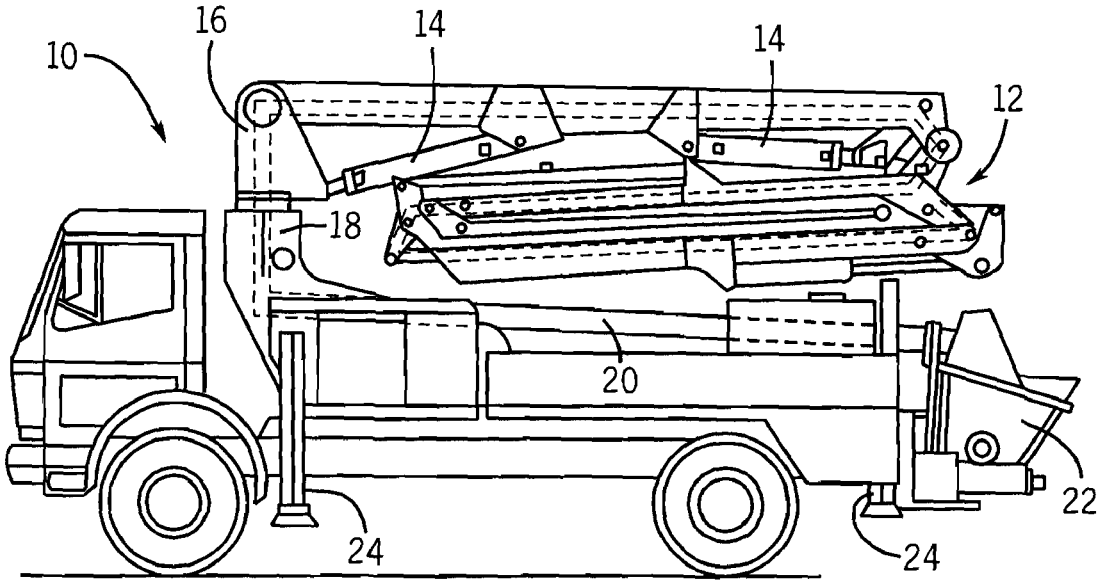
FIG. 1 is a side view of a mobile concrete pumping vehicle having an extendable boom arm in a folded condition.

Referring now to the drawings, FIG. 1 illustrates a mobile concrete pumping vehicle 10 that includes an extendable boom arm 12 having a plurality of independent sections that can be raised, unfolded and extended such as by hydraulic cylinders 14. The boom arm 12 also has a mounting block 16 that is rotatably secured to a substructure 18 of the vehicle 10 so that the boom arm 12 is rotatable about a vertical axis. Each of the sections of the boom arm 12 supports a portion of a boom pipe 20 to provide a continuous path (shown in dotted lines) for pumped concrete to flow from a storage hopper 22 to an outermost tip of the boom arm 12. The vehicle 10 is provided with extendable outriggers 24 for stabilizing the vehicle during a pumping operation.

Figure 2:
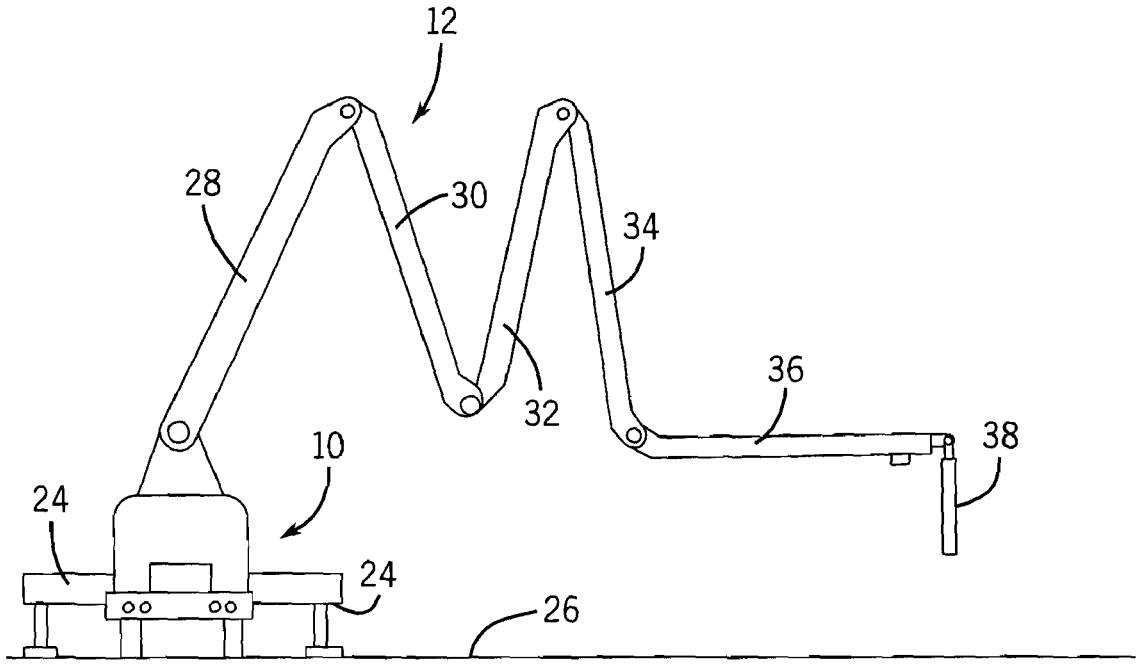
FIG. 2 PRIOR ART
FIG. 2 is an end view of a prior art concrete pumping vehicle shown with its boom arm extended and a concrete delivery hose suspended directly from a distal end thereof.

FIG. 2 shows a known prior art concrete pumping vehicle 10 with its outriggers 24 supportably engaged upon a ground surface 26 and its boom arm 12 unfolded and extended. In the example illustrated, the boom arm 12 has an innermost section 28, intermediate sections 30, 32, 34 and an outermost or tip section 36. A rubber hose or "elephant trunk" 38 typically 10 feet in length, is suspended from the outer end of the tip section 36, and is in communication with the boom pipe 20 so that concrete can be delivered from the lower end of the hose 38. As is well known, the boom pipe 20 is composed of a number of individual pipe segments joined to each other by a movable joint such that the boom arm 12 can be extended without interrupting the flow path for the concrete through the joined pipe sections and the hose 38.

As should be understood from the Background of the Invention, typical prior art concrete pumping vehicles 10 are designed with boom arms 12 having a maximum suggested weight-carrying capacity that takes into account the concrete in the boom pipe 20 and a maximum weight of the concrete filled hose 38 suspended from the tip section 36. However, in some applications, customers will proceed to have alternative concrete delivery systems that are heavier than the suggested maximum capacity for the boom arm. Because the boom tip section 36 has the weakest cross-section and is holding weight at a high moment distance from the rotational axis of the boom arm 12, the tip section 36 is often removed and replaced with an overweighted and oversized delivery system hung from the end of the preceding boom arm section 34. While this can satisfy the needs of the customer for the desired application, such modification can create serious overloading on the boom arm, pipeline supports and pipeline couplings. In accordance with the present invention, a concrete delivery support device 40 is provided on a shortened boom arm 12 in a manner that will more properly support an overweighted concrete delivery system other than a standard concrete delivery hose 38.

Figure 3:
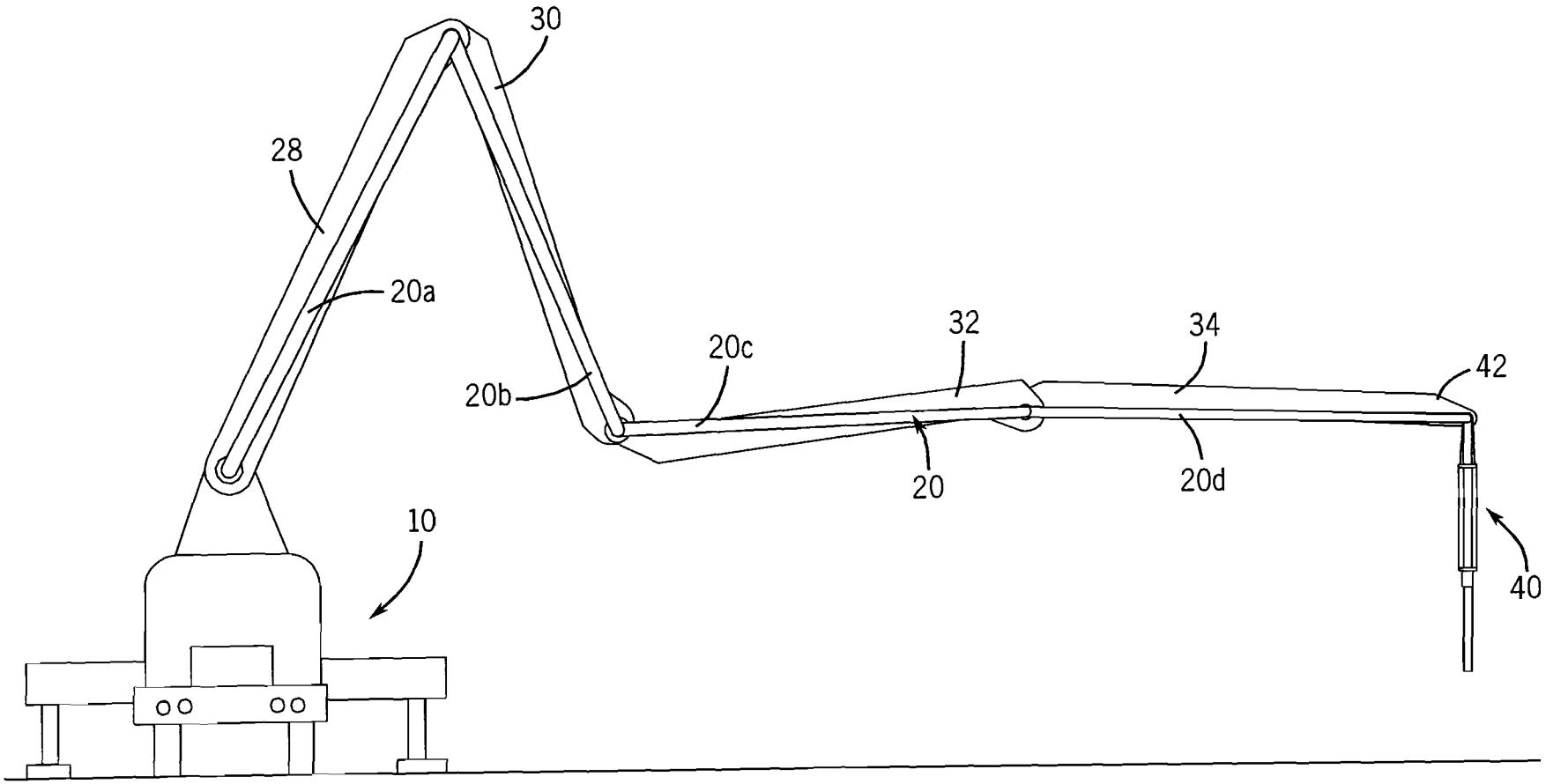
FIG. 3 is a view similar to FIG. 2 showing a concrete delivery support device attached to the distal end of the shortened boom arm in accordance with the present invention.

Referring to FIG. 3, thereshown is the concrete pumping vehicle 10 having boom arm outermost section 36 and its hydraulic cylinder assembly removed so that section 34 becomes the tip section. The last remaining section 34 has an outer end 42 where the concrete delivery support device 40 is attached. The concrete delivery support device 40 is designed to be dependent from the outer end 42 of tip section 34. Boom pipe 20 includes a segment 20*a* running along boom section 28, a segment 20*b* running along boom section 30, a segment 20*c* running along boom section 32 and a segment 20*d* running along boom tip section 34.

Although the present invention is shown in the figures as being particularly desirable for use with a mobile concrete pumping vehicle, it should be understood that the concrete delivery support device is also desirable when used with other types of concrete pumping units. For example, concrete pumping units are currently available that include an extendable boom arm where the entire pumping unit is mounted on top of a stationary mast. The boom arm is extendable from a base such that the concrete can be delivered to a remote location at a work site. A stationary mast mounted unit is particularly useful in constructing multiple floor buildings. It should also be understood that the support device 40 may also be used in connection with tubular delivery of materials from a boom arm other than concrete.

Figure 4:
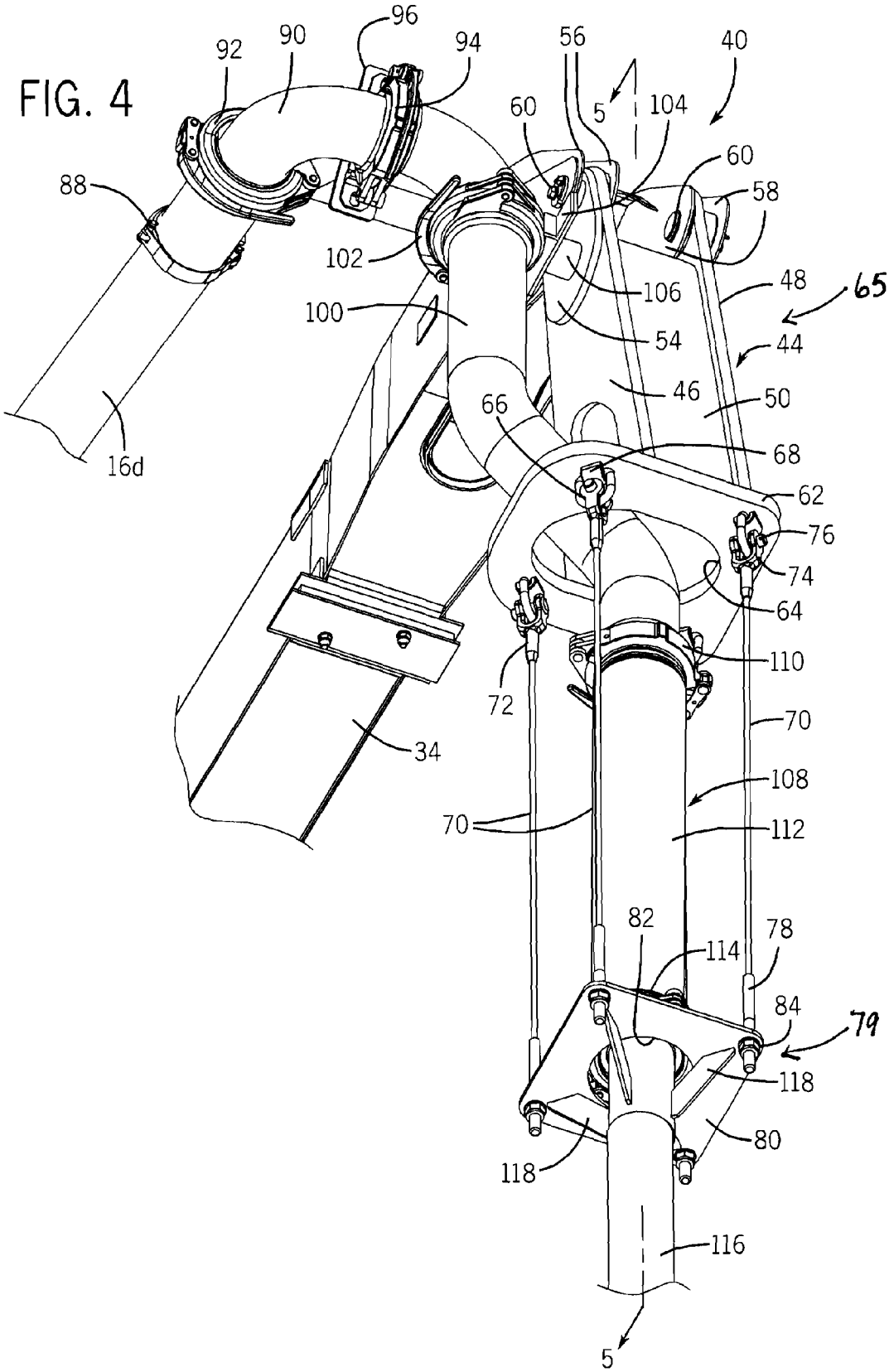
FIG. 4 is an enlarged, fragmentary, perspective view of the concrete delivery support device of FIG. 3.
Figure 5:
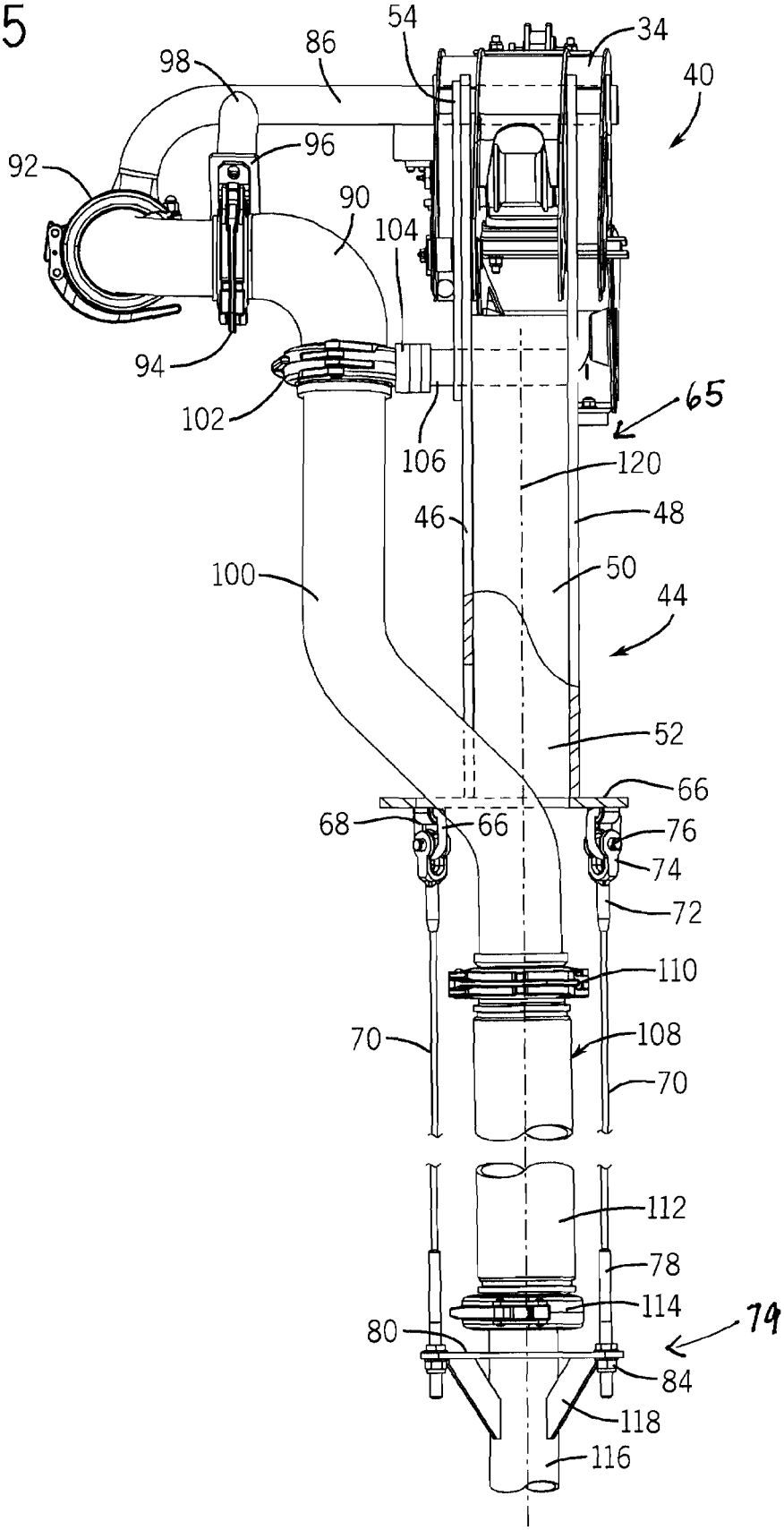
FIG. 5 is a view of the concrete delivery support device taken on line 5-5 of FIG. 4.

Referring now to FIGS. 4 and 5, the delivery support device 40 includes a rigid support member or weldment 44 having a pair of spaced apart sidewalls 46, 48, a front wall 50, and a rear wall 52. Upper ends of the sidewalls 46, 48 are constructed with reinforcing plates (one being shown at 54) and together are attached to bifurcated portions 56, 58 at the outermost end 42 of boom tip section 34 by pins 60. Weldment 44 replicates a portion of a boom section for strength and connects at an existing pivot point. A lower end of the weldment 44 is fixed, such as by welding, to an upper surface of a first flat support plate 62 which is formed with an opening 64. The rigid support member 44 and the support plate 62 combine to form a rigid support arrangement 65. An underside of the support plate 62 is provided with a series of four spaced apart rings 66, each of which is permanently held in place by a retainer 68.

Each ring 66 serves as an anchor point for a steel support cable 70 that extends downwardly away from the support plate 62. Each support cable 70 has a top end with a sleeve 72 and a U-shaped bracket 74 that is retained on the ring 66 by a fastener 76. A bottom end of each support cable 70 has a further sleeve 78 with a lower threaded end that is passed through an aperture formed in a corner of a second flat support plate 80 having a central recess 82. A nut 84 is provided on the threaded lower end of each support cable 70, and is turned tight against the underside of support plate 80. The steel cables 70 define a flexible support assembly that extends between the rigid support arrangement 65 formed by the weldment 44 and support plate 62 and the lower attachment portion 79 including support plate 80. Support plates 62 and 80 are generally in alignment with each other.

Boom pipe segment 16*d* is held spaced from the boom tip section 34 by a first tubular support 86 that extends laterally and downwardly between the tip section 34 and a band 88 attached to segment 16*d*. A pipe elbow 90 is secured to an outer end of the boom pipe segment 16*d* by a first releasable clamp 92. A second releasable clamp 94 encircles a mid-portion of the pipe elbow 90. The clamp 94, in turn, is connected to a rectangular bracket 96 and a second tubular support 98 which extends forwardly from tubular support 86 as seen best in FIG. 5. A lower end of pipe elbow 90 is coupled to an upper end of a transition hose 100 by a third releasable clamp 102. The clamp 102 is fixed to a rectangular bracket 104 at an outer end of a short tubular support 106 that extends from the plate 54 and weldment 44. Tubular elements 86, 98, 106, band 88, clamps 92, 94, 102 and brackets 96, 104 provide upper support for the boom pipe segment 16*d*, the pipe elbow 90 and the hose 100.

The transition hose 100 is configured to extend downwardly at an angle and through opening 64 in first support plate 62. A lower end of the transition hose 100 is aligned along a center axis 120 of the boom arm and is joined to a steel reducer pipe 108 by a fourth releasable clamp 110. The reducer pipe 108 includes an upper pipe 112 joined by a fifth releasable clamp 114 to a lower pipe 116 which passes through central recess 82 in lower support plate 80. Typically, the upper pipe 112 has a larger diameter (e.g. 5 inches) than lower pipe 116 (e.g. 4 inches), as well as a shorter length than a lower pipe 116. A top end of lower pipe 116 is rigidly fixed to the underside of support plate 80 by a series of four vane-like connectors 118. A bottom end of the lower pipe 116 (which may vary in length) serves as an outlet for concrete delivered from hopper 22 through boom pipe 16, pipe elbow 90, transition hose 100 and reducer pipe 108, which collectively define a tubular delivery system. The lower end of the transition hose 100, the upper pipe 112 and the upper portion of the lower pipe 116 are surrounded by the support cables 70 extending between upper and lower support plate 62, 80, respectively.

As can be seen in FIG. 5, the support device 40 is generally centered along the center axis 120. The center axis 120 forms the center axis of both the support device 40 and each section of the extendable boom arm, such as the boom arm section 34 shown in FIG. 5. Thus, the entire support device 40 and the portion of the tubular delivery system downstream from the transition hose 100 are aligned along the center axis 120 of the extendable boom arm. As can be seen in FIG. 5, the support device, and specifically the rigid support arrangement 65 including the weldment 44, positions the reducer pipe 108 and the entire tubular delivery system, such as the upper pipe 112 and the lower pipe 116, along the same center axis 120. Thus, the weight of the concrete material being delivered through the tubular material delivery system supported by the extendable boom arm is generally centered along the center axis 120 of the extendable boom arm. The construction of the support device 40 to position the weight of the concrete being pumped and the tubular delivery system attached to the boom arm along the center axis 120 balances the forces, which optimizes the flow of forces and avoids twisting.

From the construction set forth above, it should be appreciated that the collective weight of the concrete or material filled tubular delivery system is primarily supported by the upper rigid support plate 62 on weldment 44 because of the interconnection with the cables 70, lower support plate 82 and lower pipe 116. Conversely, the collective weight is not primarily supported by the reducer pipe 108, transition hose 100 or any pipeline system supports or clamp connectors.

In using the support device 40 with an overweighted load, a user removes the originally provided tip section 36, and removes the hydraulic cylinder assembly that provides articulation thereof. Removal of this hydraulic cylinder assembly enables weight reduction, provides for freedom of movement while the removal of the tip section 36 presents a clean attachment point at the outer end of the preceding boom arm 34 for an extension in the form of weldment 44. Weldment 44 is conveniently attached to existing structure at the outer end 42 of tip section 34. The support device 40 enables the lower pipe 116 to have an extended length of up to about 80 feet filled with concrete or other material without compromising the boom arm integrity. The hanging steel cables 70 will also provide an added measure of freedom of movement as side loads would not be imparted into the boom by accidental contact with any local structure. The flexible support assembly provided by the cables 70 would, for example, prevent slewing of the boom should the lower material filled pipe 116 hit the sidewalls of a hole into which the lower pipe 116 is inserted.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim

1. A material delivery support device for supporting a tubular delivery system from an outermost end of an extendable boom arm extending along a center axis and having a boom pipe, the material delivery system comprising:

a rigid support arrangement pivotally attached to the outermost end of the boom arm;

a lower attachment portion secured to the tubular material delivery system and supported by the rigid support arrangement; and a pipe elbow having a first end connected to the boom pipe supported by the boom arm and a second end connected to a transition hose that passes through the rigid support arrangement, the transition hose being connected to the tubular delivery system, the connection therebetween being centered along the center axis.

2. The support device of claim 1, wherein the rigid support arrangement is centered along the center axis and the lower attachment portion is secured to the tubular material delivery system along the center axis.

3. The support device of claim 2, wherein the tubular delivery system extends past the lower attachment portion, wherein the portion of the tubular delivery system extending past the lower attachment portion is generally centered along the center axis of the boom arm.

4. The support device of claim 1, wherein the rigid support arrangement includes a rigid support member having an upper end attached to and extending downwardly from the outermost end of the boom arm, and a lower end secured to an upper support plate.

5. A material delivery support device for supporting a tubular delivery system from an outermost end of an extendable boom arm extending along a center axis and having a boom pipe, the material delivery system comprising:

a rigid support member having an upper end attached to and extending downwardly from the outermost end of the boom arm and a lower end secured to an upper support plate, wherein the upper support plate is provided with a series of spaced apart support rings; and a lower attachment portion secured to the tubular material delivery system and supported by the rigid support arrangement.

6. The support device of claim 5, wherein the lower attachment portion includes a lower support plate spaced from and aligned with the upper support plate.

7. The support device of claim 6, further comprising a flexible support assembly extending between the rigid support arrangement and the lower attachment portion, wherein the flexible support assembly includes a series of cables having upper ends secured to the upper support plate, and lower ends attached to the lower support plate.

8. The support device of claim 5, wherein the tubular delivery system includes a pipe elbow having a first end connected to the boom pipe in communication with a source of material, and a second end connected to a transition hose that passes through the upper support plate.

9. The support device of claim 7, wherein the lower support plate is securely connected to the tubular delivery system such that the tubular delivery system is supported by the series of cables.

10. The support device of claim 5, wherein the rigid support arrangement is pivotally mounted to the outermost end of the boom arm.

11. A concrete pumping and delivery unit comprising:

an extendable boom arm constructed with a plurality of foldable sections and provided with a boom pipe carrying a supply of concrete stored on the unit;

a tubular concrete delivery system coupled to the boom pipe; and a concrete delivery support device attached to an outermost end of the boom arm for supporting the tubular concrete delivery system therefrom, the support device comprising:

a rigid support member depending from the outermost end of the boom arm and having a first support plate attached thereto;

a plurality of cables extending downwardly from the first support plate; and a second support plate spaced beneath the first support plate and joined to the set of cables and the tubular concrete delivery system.

12. The concrete pumping and delivery unit of claim 11 wherein the tubular concrete delivery system passes through the first and second support plates.

13. The concrete pumping and delivery unit of claim 11 wherein a portion of the tubular concrete delivery system is surrounded by the set of cables.

14. The concrete pumping and delivery unit of claim 11 wherein the tubular concrete delivery system comprises:

a pipe elbow connected to the boom pipe;

a transition hose joined to the pipe elbow; and a reducer pipe coupled to the transition hose.

15. A method of supporting an oversized tubular delivery system from an outermost section of an extendable boom arm constructed with a plurality of foldable sections extending along a center axis and provided with a boom pipe carrying a supply of material and a standard delivery hose depending from the boom pipe, the method comprising:

removing the outermost section of the boom arm and the standard delivery hose to create a new outermost end of the boom arm; and pivotally attaching a rigid support arrangement to the new outermost end of the boom arm;

coupling the tubular delivery system to the rigid support arrangement such that the weight of the tubular delivery system is supported by the rigid support arrangement; and coupling the tubular delivery system to the boom pipe with a transition hose that passes through the rigid support arrangement.

16. The method of claim 15 including the step of further supporting an upper portion of the tubular delivery system from the boom arm and the support member.

17. The method of claim 15 further comprising the steps of connecting the tubular delivery system to the boom pipe such that the tubular delivery system generally extends along the center axis of the boom arm.

* * * * *